US006443323B1

(12) United States Patent
DeRose

(10) Patent No.: US 6,443,323 B1
(45) Date of Patent: Sep. 3, 2002

(54) PROTECTIVE SEAL FOR CANS

(76) Inventor: Mark V. DeRose, Seshiria Koopo #203, Suginamiku Kouenji Minami 1-7-23, 166-0003 Tokyo-to (JP)

( * ) Notice: Subject to any disclaimer, the term of this patent is extended or adjusted under 35 U.S.C. 154(b) by 0 days.

(21) Appl. No.: 10/043,303

(22) Filed: Jan. 14, 2002

Related U.S. Application Data

(63) Continuation-in-part of application No. 09/757,497, filed on Jan. 11, 2001, now Pat. No. 6,338,418.

(51) Int. Cl.[7] ..... B65D 51/20
(52) U.S. Cl. ..... 220/257; 220/258; 220/906
(58) Field of Search ..... 220/257, 258, 220/906, 730, 103, 269, 270, 272, 273; 215/386, 387; 206/459.5

(56) References Cited

U.S. PATENT DOCUMENTS

| | | | | |
|---|---|---|---|---|
| 3,981,412 | A | 9/1976 | Asmus | |
| 4,162,023 | A | 7/1979 | Faltermeier | |
| D274,792 | S | 7/1984 | Price | |
| 4,609,123 | A | 9/1986 | Poncy | |
| 4,708,257 | A | 11/1987 | Deline | |
| 4,895,270 | A | 1/1990 | Main et al. | |
| 4,927,048 | A | 5/1990 | Howard | |
| 5,108,003 | A | 4/1992 | Granofsky | |
| 5,119,955 | A | 6/1992 | Granofsky | |
| D332,403 | S | 1/1993 | Johnson, III | |
| 5,292,022 | A | 3/1994 | Blanco | |
| D353,328 | S | 12/1994 | Nuffer | |
| 5,617,970 | A * | 4/1997 | Lee | 220/269 |
| 5,647,497 | A | 7/1997 | Labbe | |
| 5,720,412 | A * | 2/1998 | Ficken | 215/386 |
| 5,813,559 | A | 9/1998 | Cho | |
| 5,845,801 | A * | 12/1998 | Heitl | 220/269 |
| 5,893,477 | A | 4/1999 | Kaneko et al. | |
| 5,934,495 | A | 8/1999 | Chiodo | |
| 5,934,497 | A | 8/1999 | Chang et al. | |
| 6,015,059 | A | 1/2000 | Takayama | |
| 6,290,084 | B1 * | 9/2001 | Louie | 220/254.4 |

FOREIGN PATENT DOCUMENTS

| | | |
|---|---|---|
| EP | 385954 | 9/1990 |
| GB | 2155897 | 10/1985 |
| GB | 2156772 | 10/1985 |
| JP | 54-130295 | 10/1979 |
| JP | 2-258550 | 10/1990 |
| JP | 10-214027 | 8/1998 |
| JP | 11-301668 | 11/1999 |
| WO | 89/11421 | 11/1989 |

* cited by examiner

*Primary Examiner*—Nathan J. Newhouse
*Assistant Examiner*—Lien Ngo
(74) *Attorney, Agent, or Firm*—Richard C. Litman

(57) ABSTRACT

A protective seal for beverage cans, etc. completely covers and seals the mouth contact area of the can, thereby protecting that area from contamination. The present seal comprises a thin, durable, impervious sheet applied to the top of the can surrounding the opening area, extending down the upper side of the can adjacent the top opening area for a short distance to cover the mouth contact area of the can. The seal is peripherally sealed to the can surface by a narrow strip of food grade adhesive. The tab attachment extension of the seal may include bushings, washers, etc. to provide clearance for the majority of the seal to pivot between the pop tab lever and can top, and/or may include a circumferential weakening line about the pop tab rivet to allow the majority of the seal to shear circumferentially to pivot about the captured rivet attachment portion thereof.

20 Claims, 6 Drawing Sheets

PROTECTIVE SEAL FOR CANS

CROSS-REFERENCE TO RELATED APPLICATION

This application is a continuation in part of U.S. patent application Ser. No. 09/757,497, filed Jan. 11, 2001.

BACKGROUND OF THE INVENTION

1. Field of The Invention

The present invention relates generally to covers, caps, tops, and lids for containers, and more specifically to a protective seal which covers the area around the openable tab on a beverage can or the like. The present protective seal maintains a hygienic and sanitary area around the area of the tab and immediately below the tab on the side of the can before the can is opened, thereby providing a sanitary contact area for the mouth of a person consuming the contents of the can after opening.

2. Description of the Related Art

The consumption of beverages from cans has become ever more popular, perhaps due to the pace of modern life and the lack of time for many people to stop for refreshments at a cafe or the like. In any event, the marketplace has responded by providing a myriad of different flavors, types, and sizes of beverages in both bottles and cans, for purchase either over the counter or from vending machines.

A problem which is universal to the provision of such beverages in cans, is the handling of the cans before purchase and consumption. Even when such cans are prepackaged in six packs, cases, etc., the cans are almost always contaminated with dirt or grime from the packaging and shipping process. Most group type containers do not cover the tops of the cans to protect this area, but rather are simple distensible plastic rings which surround the tops of the cans to secure a group of cans together. This problem also exists for cans purchased from vending machines, as they must be separated by hand from any packaging and placed in the vending machine individually. The result of the handling and storage life of such canned products, is that the cans, and particularly the tops of the cans, are almost always contaminated with dust, grime, and/or hand contact from persons handling the cans before final purchase.

Accordingly, a need will be seen for a protective seal which is applied to the top of the can immediately after the can has been filled, while it is still in a sanitary and hygienic environment. The protective seal extends from the center of the top of the can where it is anchored by the conventional rivet of the pop tab opening, across the area of the pop tab and downwardly over the upper portion of the can adjacent the pop tab opening. The seal protects this mouth contact area of the can until it is removed by the consumer, thereby protecting the mouth contact area of the can from contamination and assuring the consumer that the mouth contact area of the can is sanitary before consumption of the contents.

A discussion of the related art of which the present inventor is aware, and its differences and distinctions from the present invention, is provided below.

U.S. Pat. No. 3,981,412 issued on Sep. 21, 1976 to Richard W. Asmus, titled "Container Closure," describes various lid or top embodiments for cans and bottles. In one embodiment (FIG. 12), a supplemental cover is secured to the top of a can by means of segmented helical protuberances stamped in the upper side walls of the can, to serve as screw threads for the cover. However, the elevation view in section of FIG. 12 of the Asmus patent, clearly shows that the sides of the cover do not seal against the sides of the can to provide a hygienic mouth contact area for the can, as provided by the present seal. Moreover, Asmus requires that the can be modified with the stamped thread portions, whereas cans used with the present invention do not require any modification.

U.S. Pat. No. 4,162,023 issued on Jul. 24, 1979 to Heinz J. Faltermeier, titled "Dust Cover For Flip Top Opening Containers," describes a sanitary cover which secures about the crimped upper edge of the can. The Faltermeier cover is relatively complex, as it has a multiple fold which extends beneath the lift tab of the pop tab opener for the can. In any event, the Faltermeier cover does not extend downwardly along the side of the can to a sufficient depth to cover the mouth contact area of the can, as provided by the present invention. Moreover, Faltermeier does not provide a positive seal nor any transparency for his cover, as provided by the present protective seal.

U.S. Pat. No. 4,609,123 issued on Sep. 2, 1986 to George W. Poncy, titled "Beverage Can With Sanitary Reclosable Lid, " describes various can embodiments, each having a double upper top or lid. The outermost lid serves as a cover for the underlying lid, and also provides means for resealing the container if so desired. The upper or outermost lid is crimped to the upper edge of the can along with the inner lid, and thus cannot swivel relative to the lower lid or remainder of the can, as provided by the present seal. The outermost lid of the Poncy can includes a pop tab or the like therein, and acts just as the single conventional lid in a conventional can. Thus, Poncy provides only a resealing capability, and does not provide any additional sanitation or hygiene for the mouth contact portion of the can or lid. Moreover, the Poncy cover is not transparent, whereas the present seal is preferably transparent in order to show any underlying advertising messages or the like.

U.S. Pat. No. 4,708,257 issued on Nov. 24, 1987 to Douglas N. Deline, titled "Protective Seal For A Can," describes a flat, thin sheet of plastic film which is adhesively attached to the rim of a can to seal the upper surface thereof. A pull tab extends from one side for removing the cover partially from the upper lid of the can, to expose the conventional pop tab. While the Deline seal protects the lid or top of the can, it does nothing to protect the mouth contact area along the upper side of the can, adjacent the pop tab opening. Moreover, the Deline seal does not swivel for clearance from the opening, nor is it transparent.

U.S. Pat. No. 4,895,270 issued on Jan. 23, 1990 to Daniel M. Main et al., titled "Sanitary Cover For Pop-Top Beverage Container," describes various embodiments of a thin latex cover which is applied over the upper end of a can to protect that portion of the can. The cover includes weakening lines for tearing the cover at least partially, for exposing the underlying can top and its pop tab. However, Main et al. do not provide any positive attachment for their cover by means of the conventional pop tab rivet, as provided by the present invention. This allows the present protective seal to be swiveled out of the way after the adhesively attached edges are lifted, unlike the Main et al. cover. Moreover, Main et al. are silent regarding any transparency for their cover, whereas the present seal may be transparent.

U.S. Pat. No. 4,927,048 issued on May 22, 1990 to Roy T. Howard, titled "Beverage Can Having A Sanitary Cover," describes a cover formed of a thin aluminum sheet which closely adheres to the contours of the can top. However, the only portion of the Howard cover which extends beyond the can top, is for the pull tab extension which wraps downwardly slightly below the upper rim of the can. Accordingly, the Howard cover does not appear to cover and protect the entire mouth contact area of the can, as does the present seal, particularly in view of the fact that the Howard lift tab must not be sealed to the can in order to allow it to be lifted easily for removing the cover. Also, the aluminum material of the Howard cover precludes transparency, which is provided by the present sanitary protective seal.

U.S. Pat. No. 5,108,003 issued on Apr. 28, 1992 to Barry P. Granofsky, titled "Cover For Beverage Can," describes a nonswivel cover which extends over the entire top of the can. A circumferential pull tab provides for release of the portion of the cover which extends over the opening in the upper lid of the can. A cap is included beneath the removable portion of the cover, for resealing the can as desired. Accordingly, the Granofsky cover cannot be used with a conventional can with a pop tab opening, as the attachment edge of the pop tab would preclude a good fit and seal for a plug type cap, as provided by Granofsky. Moreover, Granofsky is silent regarding any transparency for his cover.

U.S. Pat. No. 5,119,955 issued on Jun. 9, 1992 to Barry P. Granofsky, titled "Sanitary Can Closure," describes a cover closely resembling that of the '003 U.S. Patent to the same inventor, discussed above. Accordingly, the same points of distinction noted above between the cover of the '003 Granofsky U.S. Patent and the present invention, are seen to apply here as well.

U.S. Pat. No. 5,292,022 issued on Mar. 8, 1994 to Arsenio G. Blanco, titled "Closure For Beverages Metal Containers," describes two different embodiments for such covers, with one embodiment covering only the pop tab opening area of the can. This cover is opened as the pop tab is pulled. The other embodiment covers the entire top of the can, but is split diametrically as the can is opened to roll clear of the opening. Neither embodiment extends downwardly to cover the mouth contact area of the can below the rim, and no transparency is described by Blanco.

U.S. Pat. No. 5,647,497 issued on Jul. 15, 1997 to Andre Labbe, titled "Protective Removable Cover For Beverage Container," describes various embodiments of such covers. Most of the embodiments cover the entire top of the can, unlike the present seal invention, but Labbe does not provide for complete coverage of the mouth contact area of the can by extending his cover downwardly over the side of the can past the rim to cover the lower lip contact area, as provided by the present seal. In one embodiment, Labbe provides only a partial top cover, but teaches away from the present seal invention by avoiding the rivet attachment area for the pop tab. This precludes any swivel attachment for the Labbe seal, with the seal thus separating completely from the can after opening. In contrast, the present seal remains attached by the pop tab rivet, precluding its loss and possible littering. Also, Labbe is silent regarding any transparency for his covers, whereas the present seal may be made transparent (or at least translucent), allowing any advertising or other matter beneath the seal to be visible to the consumer.

U.S. Pat. No. 5,813,559 issued on Sep. 29, 1998 to Sung Ho Cho, titled "Beverage Can With Sanitary Cover," describes various embodiments of a seal which is secured to the top of a beverage can by means of the conventional pop tab and rivet assembly. However, the Cho seal differs considerably from the present beverage container seal, in that (a) the Cho seal subtends a considerably smaller area of the can top, than does the present seal; (b) the Cho seal does not extend downwardly to cover a portion of the upper edge of the can side, as does the present seal; and (d) Cho does not disclose any form of adhesive or sealant for providing a seal between the edge of his seal cover and the can surface to preclude the entry of dirt and the like therebetween, whereas the present can and seal provide such a peripheral adhesive seal. It is also noted that the Cho seal is relatively rigid, with no flexibility being apparent for peeling the Cho seal away from the surface of the can, as can be done with the present seal. In one embodiment, the Cho seal must be sufficiently rigid to serve as the pop tab lever for opening the can.

U.S. Pat. No. 5,893,477 issued on Apr. 13, 1999 to Masamichi Kaneko et al., titled "Receptacle For Liquids," describes a cover which closely resembles that of the Deline '257 U.S. Patent, discussed further above. The same differences and distinctions noted between the cover of the Deline '257 U.S. Patent and the present invention, are also felt to apply here.

U.S. Pat. No. 5,934,495 issued on Aug. 10, 1999 to Maurizio Chiodo, titled "Protective Film For Cans Or Drink And Food Containers In General," describes different embodiments of a cover or seal for beverage cans. In one embodiment, the seal completely covers the entire can. While the side of the can is apparently visible through the seal film, the upper end of the can is obviously not visible, as indicated by the broken line showing of the pop tab and lift ring. In contrast, the entire seal of the present invention is transparent, allowing advertising or the like to be viewed through the seal. Moreover, the Chiodo seal embodiments which cover only the top of the can do not extend downwardly past the top to protect the lower lip contact area of the can, as provided by the present seal. Chiodo also covers the entire top of the can, precluding swiveling his seal out of the way but allowing it to remain attached to the can, as provided by the present seal invention.

U.S. Pat. No. 5,934,497 issued on Aug. 10, 1999 to Charles Chang et al., titled "Sanitary Beverage Can Lid," describes a specially formed lid for a can, rather than a removable cover. The Chang et al. lid is permanently and immovably attached to the can at manufacture, rather than being a movable or removable cover for a portion of a fixed lid, as in the present invention. The Chang et al. lid is configured to provide ease of access to the surface adjacent the opening area, for ease of cleaning that surface. However, Chang et al. do nothing to protect that area in the first place, nor do they protect the upper side of the can.

U.S. Pat. No. 6,015,059 issued on Jan. 18, 2000 to Yoshikazu Takayama, titled "Can With Seal," describes various embodiments of covers or seals for the tops of cans. One embodiment (FIG. 8) adheres to the top of the can around its periphery, but attaches only to a portion of the top of the can. While Takayama states that his seal "covers a peripheral portion of the can to be contacted by the lower lip" (col. 2, lines 58–59), this is only a portion of the mouth contact area as defined within the present disclosure. The lower lip normally contacts the side of the can somewhat below the periphery of the top or lid. Thus, covering only this periphery without covering a portion of the upper side of the can therebelow, as is the case with the Takayama seal, does not provide the needed total coverage which is provided by the present seal. Also, Takayama is silent regarding any means for pivoting or swiveling his seal to a position opposite the opening in the top of the can, as provided by the present invention. Further, the only transparency provided by Takayama for his seal is in a relatively small area directly over the pop tab opening (or "tap," as referred to by Takayama) permitting the consumer to confirm the opened state of the pop tab after manipulating the tab lever (Col. 3, lines 24–26). Takayama does not teach the use of a transparent sheet for his entire seal, but only for the "window" area for noting the state of the "tap." Otherwise, Takayama refers only to opaque materials (e. g., aluminum foil, col. 2, lines 3–4). The use of a composite sheet formed of both opaque and transparent materials, obviously increases the production costs for the Takayama seal.

U.S. Pat. No. D-274,792 issued on Jul. 24, 1984 to Floyd J. Price, titled "Sealing Cap For Soda Cans Or The Like," illustrates a design having a circular cross section rim with an overlying cover. The design is apparently opaque, does not attach to the rivet of the pull tab of a can, is completely separable from the can, covers the entire top of the can, and does not cover any of the side portion of the can below the crimped rim of the top, all of which features are opposed to those of the present invention.

U.S. Pat. No. D-332,403 issued on Jan. 12, 1993 to John H. Johnson, III, titled "Can Cap," illustrates a design which appears to have an extension for inserting into the opened opening of a pop tab type can. Otherwise, the various features noted in the discussion of the design of the Price '792 U.S. Patent immediately above, also apply to the Johnson, III design and teach away from the structure and features of the present can seal.

U.S. Pat. No. D-353,328 issued on Dec. 13, 1994 to Richard Nuffer, titled "Pop Top Can Cover," illustrates a design comprising a retaining ring having a cover attached thereto by a live hinge. The design does nothing to protect the lower lip contact area of the can below the opening, and is not permanently attached to the can as in the case of the present seal. Moreover, the Nuffer design is opaque, rather than transparent, and covers the entire top of the can, unlike the present seal invention.

Japanese Patent Publication No. 54-130,295 published on Oct. 9, 1979 to Sekisui Chemical Company, Ltd., describes (according to the drawings and English abstract) a cup and cover assembly, in which the cover is permanently sealed to the upper edge of the cup. The cover has an overlay with an area defined by lines of weakening to provide a tear away strip to expose an underlying opening in the lower cover sheet. The assembly is not configured for use with a pop tab type can, does not protect the area surrounding the opening or along the upper sidewall portion of the container, does not retain the removed seal portion, and is not transparent, all of which are features of the present seal invention.

British Patent Publication No. 2,155,897 published on Oct. 2, 1985 to Scottish & Newcastle Breweries Plc, titled "Seals For Liquid Containers," describes the manufacture of seals for larger containers, i. e., beer kegs. The seals are applied to a continuous length of carrier material, with a continuous length of string or the like looped under each seal. The string is cut when each seal is applied to a keg, with the free end(s) of the string extending from beneath the seal to provide for ease of removal. The seals themselves bear no resemblance in structure or function to the present can seal invention.

British Patent Publication No. 2,156,772 published on Oct. 16, 1985 to Jorge M. Burcat, titled "A Beverage Can," describes a two piece seal for use with removable pull tab type openers. The seal extends across the pull tab and downwardly over the lower lip contact area of the can, but is completely removed from the can when the pull tab is removed, whereas the present seal remains attached to the can and swivels clear of the opening. Burcat is silent regarding any transparency for his seal.

PCT Patent Publication No. 89/11,421 published on Nov. 30, 1989 to Jacques Boisson et al. describes (according to the drawings and English abstract) several embodiments of seals or covers for can tops, with the closest embodiment to the present invention apparently being illustrated by FIGS. 1 and 2. The seal of the '421 PCT Publication extends over the pull tab opening area of the can and downwardly over the lower lip contact area of the sidewall of the can. The seal is only secured to the can adhesively; it is not secured in place mechanically, as by securing it beneath the pop tab ring of the can, as in the present invention. However, the English abstract states that the protective film remains attached to the container, with FIG. 2 showing the removal of the pull tab and the film clinging to the sidewall of the can immediately adjacent the top opening. This is obviously cumbersome, as both the attached pull tab and the loosened flap of the seal impinge upon the lower lip contact area of the can and preclude the comfortable consumption of the contents of the can. The present invention overcomes this problem by pivoting or swiveling the seal around the pop tab rivet to the opposite side of the can from the opening. While it is noted that FIG. 13 of the '421 PCT Publication illustrates the attachment of a secondary cover by means of a central rivet in the top of the can, the secondary cover in this embodiment is circular and cannot be swiveled to provide clearance for accessing the can opening. Rather, at least one side of the cover is peeled upwardly to expose the opening in the can, and must be held in that position during consumption of the can contents. No suggestion of any combination of the embodiments of FIGS. 1 and 2 and FIG. 13 is made in the '421 PCT Patent Publication, nor is any indication of transparency noted.

European Patent Publication No. 385,954 published on Sep. 5, 1990 to Ferruccio Canini, titled "Device For Hygienic Protection Of Drinks, Edible Liquids And Other Products In General," describes several embodiments of a can seal. In the embodiment of FIG. 1, the seal does not cover any of the can side, thus allowing the lower lip to contact a possibly contaminated area of the can even after the seal has been removed. The embodiment of FIG. 9 appears most closely related to the present invention, but is more closely related to the embodiment of FIGS. 1 and 2 of the '412 PCT Patent Publication discussed immediately above. The same differences noted in that discussion, are seen to apply here.

Japanese Patent Publication No. 2-258,550 published on Oct. 19, 1990 to Arai Minoru describes (according to the drawings and English abstract) a retainer for an otherwise removable pull tab for a can. The retainer is a generally circular device seated in the circumferential groove in the top of the can. It is attached to the pull tab and also to the top or adjacent side of the can, opposite the pull tab. When the tab is pulled to open the can, it remains attached to the retainer, which remains attached to the opposite side of the can to preclude loss of the removed tab. The device does nothing to protect the mouth contact area of the can from contamination, nor to protect a person consuming the contents of the can, as provided by the present seal.

Japanese Patent Publication No. 10-214,027 published on Aug. 11, 1998 apparently illustrates a seal for the opening area of a can. However, the seal does not extend to the center of the can, and thus cannot pivot about any attachment rivet holding the pop tab lever to the top of the can, as provided by the present seal. Also, no adhesive or other positive sealing means is apparent.

Finally, Japanese Patent Publication No. 11-301,668 published on Nov. 2, 1999 appears to include two embodiments of protective seals for cans. One embodiment appears to surround the entire upper periphery of the can top, and apparently lifts upwardly at the edge adjacent the tab opening, but remains secured to the opposite upper edge of the can. The other embodiment appears to cover only a portion of the top and upper periphery of the can. This embodiment appears to be secured to the lifter end of the pop tab lever. While this seal can apparently be lifted clear of the top of the can, there is no apparent means for swiveling either seal embodiment clear of the opening, as provided by the present can seal invention.

None of the above inventions and patents, either singly or in combination, is seen to describe the instant invention as claimed.

SUMMARY OF THE INVENTION

The present invention comprises a protective seal for cans, for sealing the mouth contact area of an otherwise conventional beverage can or the like to protect that area from contamination during handling and storage. The seal is adhesively secured to the top of the can around the pop tab opening and along the upper side of the can adjacent the opening, and is further attached to the can by the rivet securing the pop tab pull ring to the can. The seal is preferably formed of a transparent material so that any advertising or other message provided on the surface of the can below the protective seal, may be read by the consumer.

The seal is pivotally secured to the top of the can by means of the conventional rivet which secures the pop tab lever to the top of the can. In order to provide for the rotation of the seal about the top of the can after the peripheral adhesive has been separated, a circumferential weakening line (e. g., perforations, thinner area, etc.) may be provided immediately adjacent the attachment rivet. The portion of the seal sheet immediately adjacent the rivet and sandwiched between the pop tab lever and the top of the can, thus remains stationary while the balance of the seal sheet shearing circumferentially along the line of weakening to pivot about the stationary center portion and its attachment rivet.

In addition, the centermost attachment area of the seal may be provided with a thickened area, acting as a bushing or bearing between the pop tab lever and the top of the can. Alternatively, separate washers may be used to provide this function. This thickened area serves to provide clearance for the thinner portion of the seal to rotate between the pop tab lever and the can top, to facilitate rotation of the seal to clear the can top opening area. Alternatively, the washers can reduce friction to allow the entire protective sheet to rotate about the rivet, thereby precluding need for a circumferential weakening line about the rivet attachment.

A person consuming the contents of the can peels back the seal and pivots the seal around the pop tab rivet to the opposite side of the can, then opens the pop tab to consume or pour the beverage with assurance that the mouth contact area of the can has remained in a sanitary condition. The seal remains attached to the can at all times due to its attachment to the pop tab ring attachment rivet and thus cannot be discarded separately from the can, thereby reducing litter. The seal is preferably formed of a thin, durable, biodegradable plastic or other suitable sheet material, in order for the can and seal assembly to be recycled after use and to reduce waste. As noted above, the seal is preferably transparent, but may be tinted or shaded as desired to provide an attractive appearance. The seal may also include instructions, an advertising message(s), etc. thereon, if so desired.

Accordingly, it is a principal object of the invention to provide an improved protective seal for cans, with the seal covering the top of the can in the area of the opening therein and the upper side of the can adjacent the opening, thereby protecting the mouth contact area of the can from contamination.

It is another object of the invention to provide an improved protective seal for cans, which seal is formed of a thin, flexible, durable, impervious sheet of plastic or other suitable material.

It is a further object of the invention to provide an improved protective seal for cans which seal is adhesively secured to the can generally about the periphery of the seal, by means of a food grade adhesive which is resistant to temperature extremes.

An additional object of the invention is to provide an improved protective seal for cans which seal is also mechanically secured to the top of the can by means of the conventional pop tab pull ring attachment rivet provided with the can, thereby providing for the seal to be pivoted to the opposite side of the can from the opening in the top of the can after separating the adhesive attachment of the seal to the can.

Still another object of the invention is to provide an improved protective seal for cans which is transparent or translucent, and which may include instructional and/or other messages thereon.

Yet another object of the invention is to provide an improved protective seal for cans which includes bearing and/or bushing means surrounding the pop tab attachment rivet and sandwiching the seal attachment extension therebetween, and/or a circumferential weakening line surrounding the rivet attachment, whereby the seal may be sheared along the weakening line to pivot about the stationary extension portion gripped between the pop tab lever and the top of the can.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a protective seal for beverage cans, etc., applied at the time of sealing the contents in the can. As the filling of the can is accomplished under necessarily hygienic conditions to protect the interior of the can and its contents, the application of the present seal at that time assures that the underlying surface will retain its hygienic condition. The present protective seal covers the mouth contact area of the can, thereby assuring the consumer that this mouth contact area remains sterile and hygienic and is not contaminated by dirt, dust, spilled substances, etc. during shipping and handling.

Figure 1:
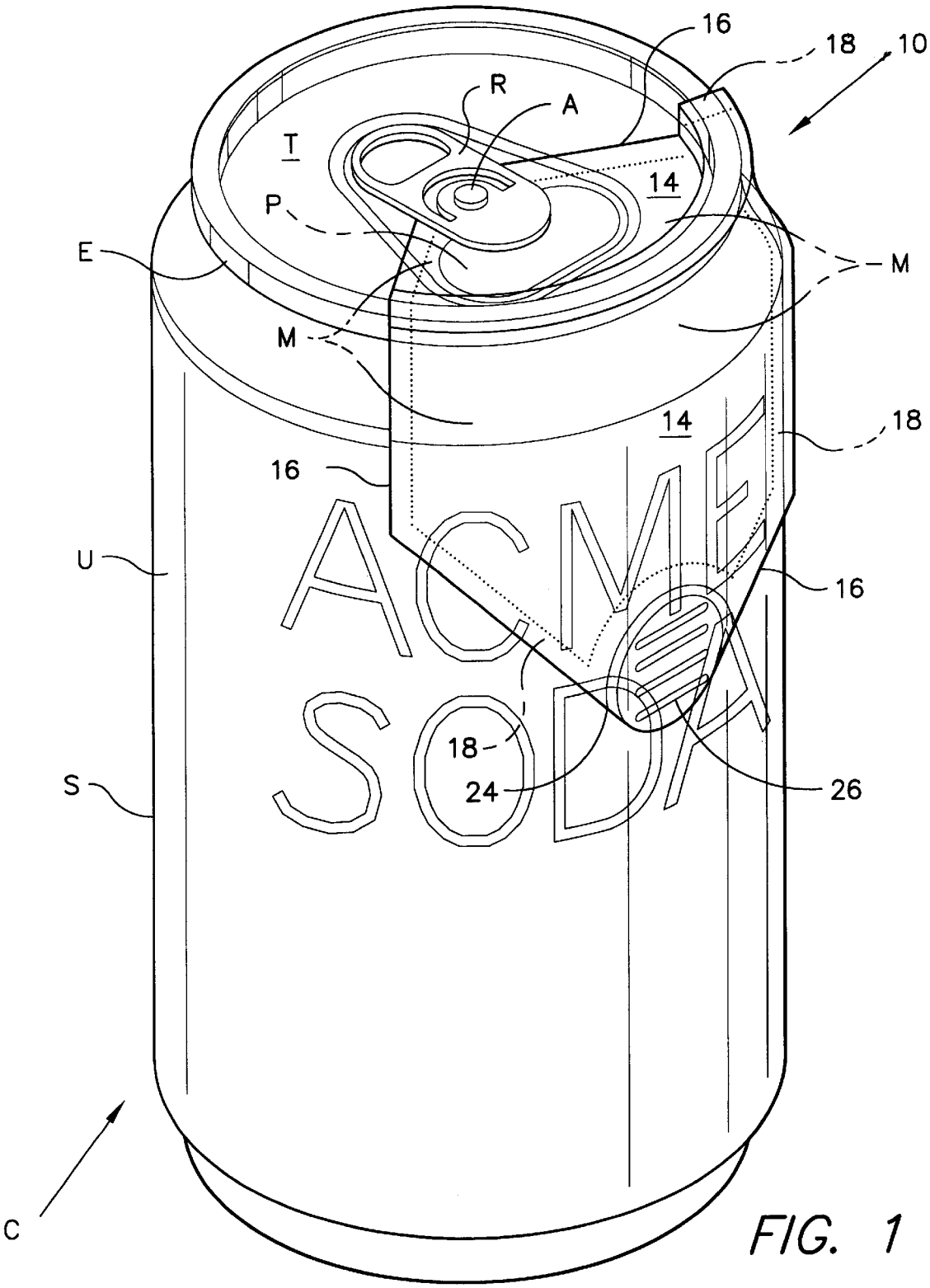
FIG. 1 is a top and front perspective view of a beverage can equipped with the present protective seal, showing its general configuration.

FIG. 1 of the drawings provides a perspective view of a can C incorporating the present protective seal 10 therewith. The can C is conventional with the exception of the seal 10 disposed thereon, with the can C essentially comprising a bottom (not shown, and not critical to the present invention), a sidewall S and a top T. The top T is conventionally formed of a separate sheet of material from the sidewall S, and is crimped and sealed in place to the upper edge of the sidewall S, as is conventional in such practice. The top T includes a conventional pop tab assembly, comprising a pop tab P which is conventionally stamped into the top T to define a sealed opening within the top T. A pop tab pull ring R is attached to the top T adjacent to the pop tab P by an attachment rivet A.

When the pop tab P is opened, it defines an opening O (shown in FIG. 6) from which the contents of the can C are poured or consumed. This opening is conventionally positioned from a point near the edge E of the top T, to a bend line opposite the rivet A. A person drinking directly from the can C would place his/her mouth in this area, with the upper lip extending laterally to each side of the opening O and the lower lip contacting the upper sidewall U of the can C directly below the opening O defined by the pop tab P. This area comprises the mouth contact area M for a conventional can C, and the seal 10 provides a means for keeping this mouth contact area M in a clean and hygienic condition. Even when a beverage is poured from the can C to another container (glass, cup, etc.), the beverage flows at least partially over this mouth contact area M, with the seal 10 providing a hygienic surface before pouring.

The seal 10 is formed of a thin, flexible, durable, impervious sheet of material, such as a thin plastic or other suitable material. The sheet 10 material is preferably biodegradable and is destroyed by the heat developed during the recycling process used with the cans C, thereby avoiding additional litter and waste. Various polymers and other thin sheet materials are known to have the desired characteristics of the present protective seal 10, and may be used as desired. The present seal 10 is preferably quite thin in order to allow a series of such cans C equipped with the present seal 10 to be stacked atop one another without appreciable interference by the thickness of the seals 10, and to adhere and conform closely to the contours of the can C, particularly the crimped edge E of the top T. It will be noted that the thickness of the protective seal 10 is greatly exaggerated throughout the drawing Figures, to provide clarity in the drawings.

Figure 2:
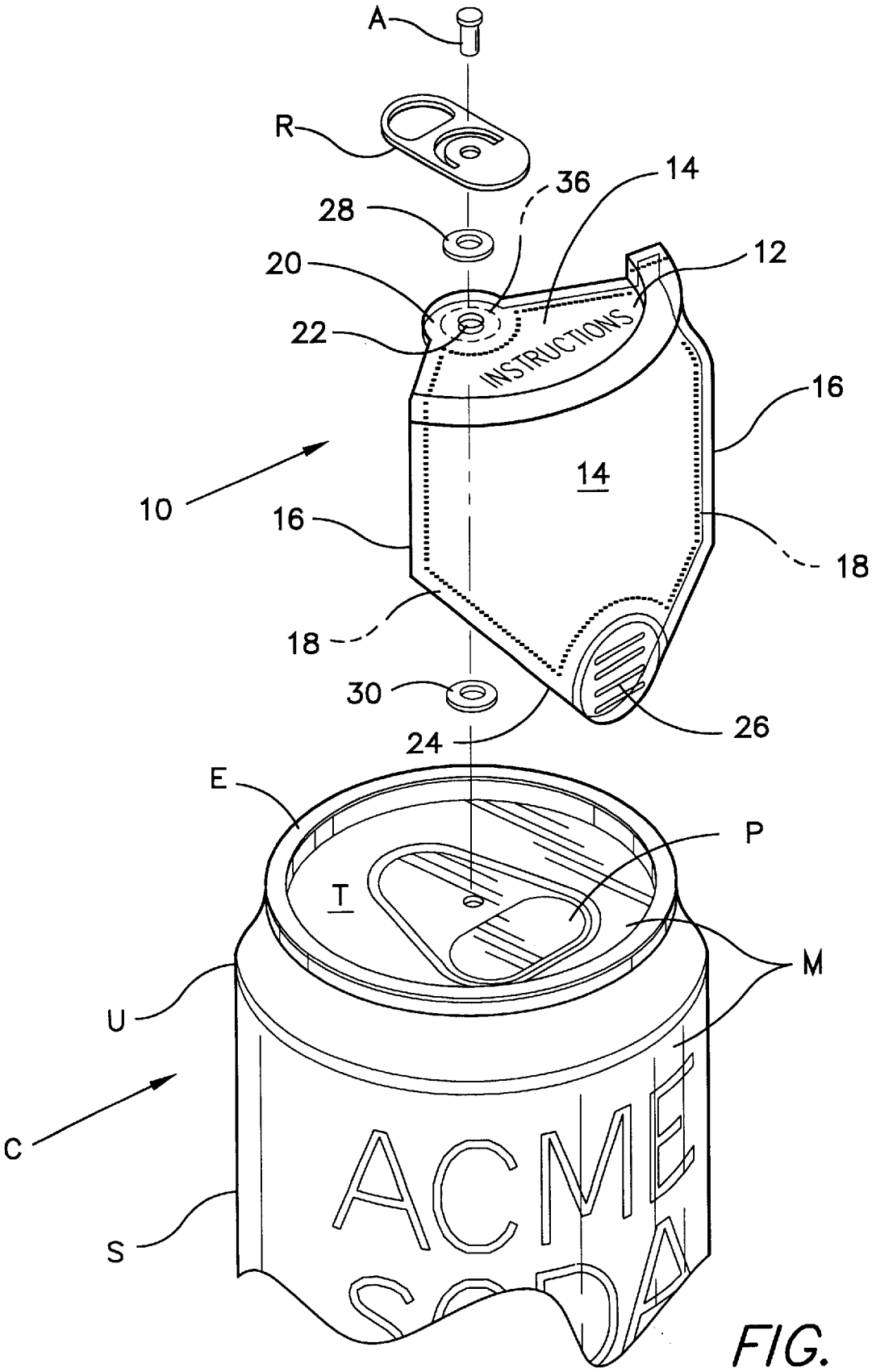
FIG. 2 is an exploded perspective view of the upper portion of the can and seal assembly of FIG. 1, illustrating an embodiment including separate extension area gripping washers and circumferential perforation for separating the main seal portion.
Figure 4:
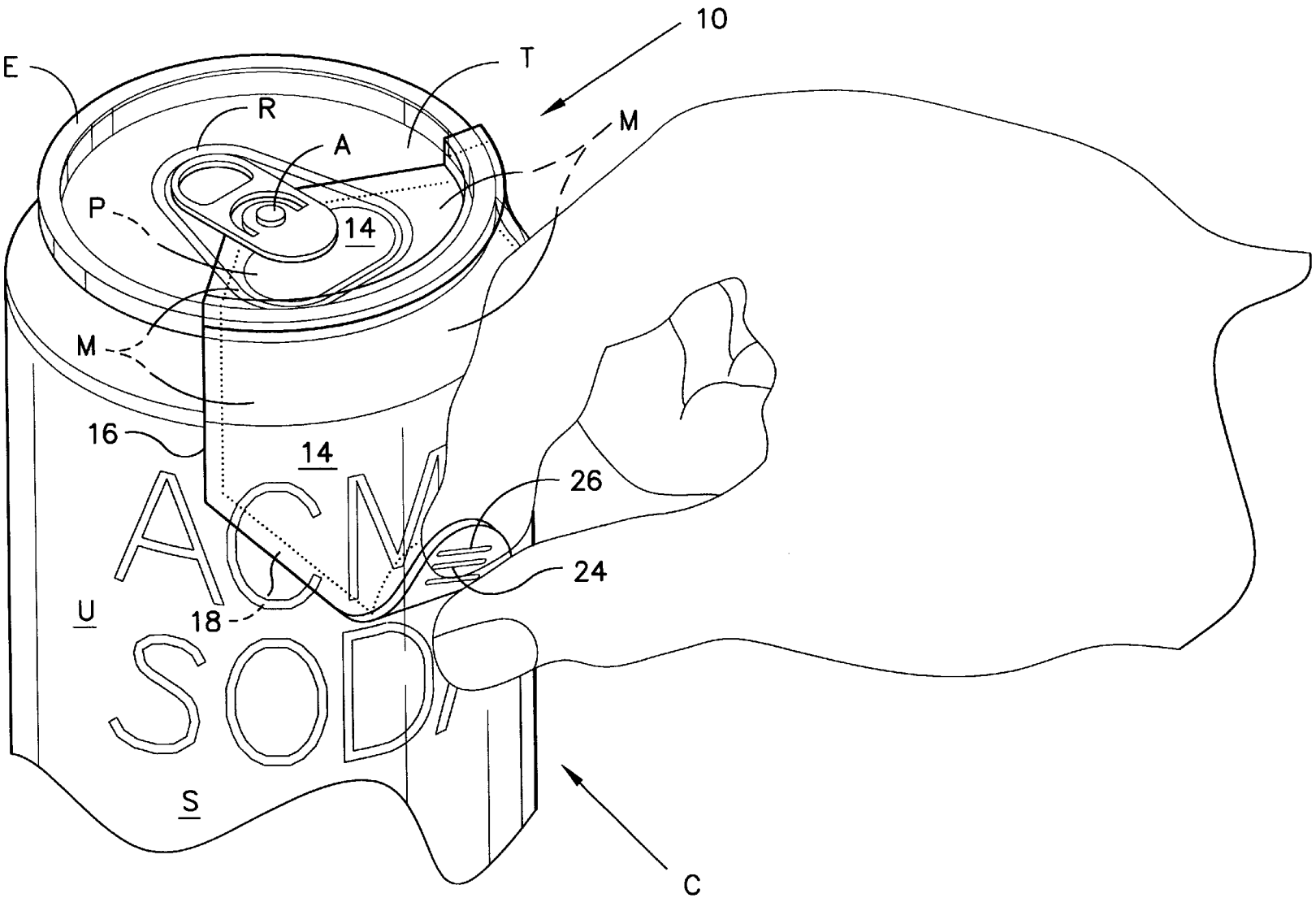
FIG. 4 is a perspective view of the upper portion of the can and seal assembly, showing the first step in the opening of the seal and can.
Figure 5:
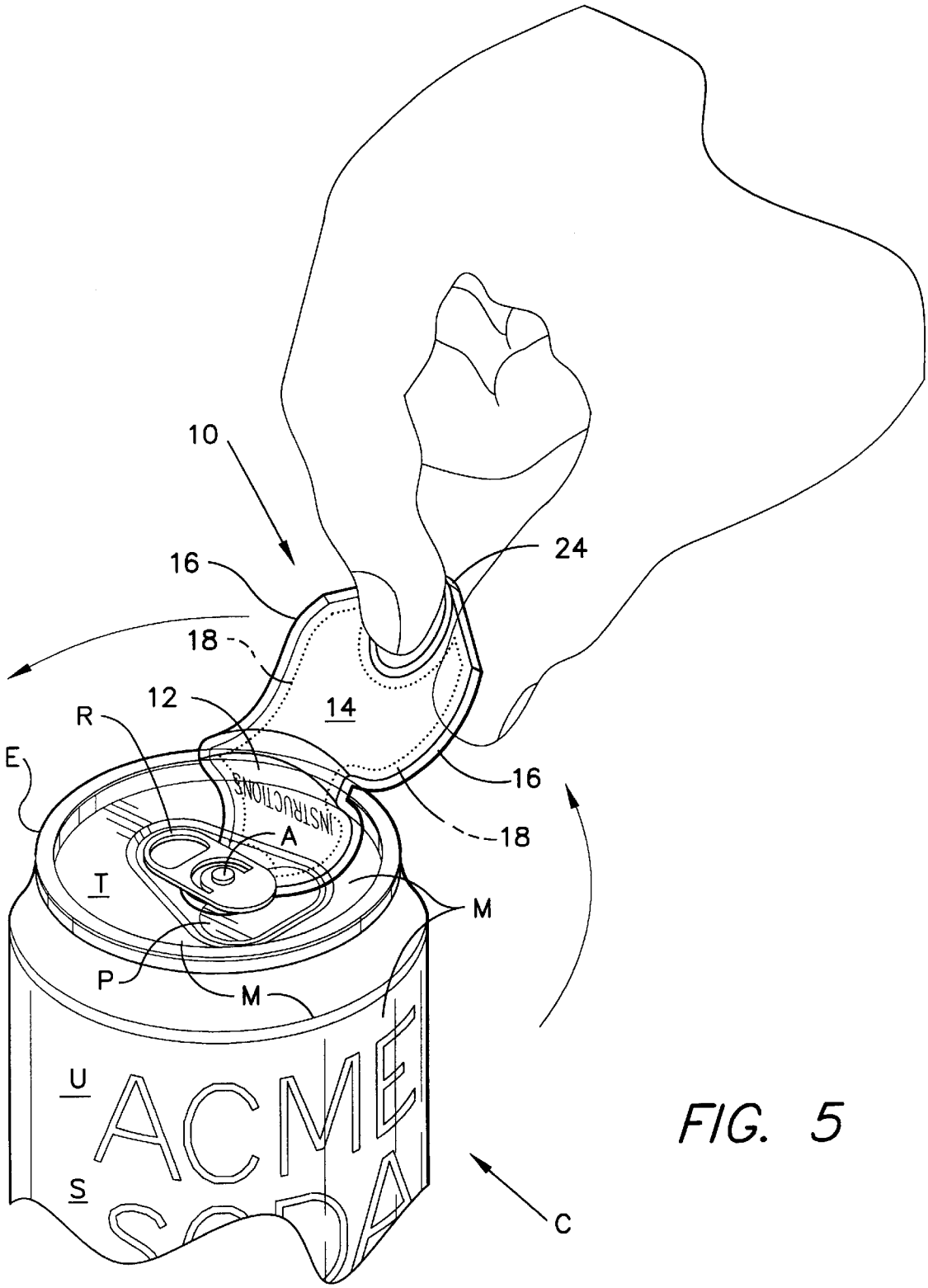
FIG. 5 is a perspective view of the upper portion of the can and seal assembly of FIG. 4, showing the second step in the unsealing and opening process.

The present seal 10 is preferably transparent as shown throughout the drawing Figures, in order to allow consumers to inspect the underlying surface of the can C for damage and to allow any decoration, advertising indicia, etc. to be viewed through the seal 10. However, a tint or shading may be added to at least some portion of the seal 10 (e. g., the area covering the top T of the can C, which normally remains plain and unadorned) in order to show clearly the extent of the seal 10. In addition, the seal 10 is capable of accepting some form of message(s) thereon, e. g., instructions 12 for opening the seal 10, as shown in FIGS. 2, 4, and 5, or advertising, decorative embellishment, etc., as desired.

The protective seal or sheet 10 includes a mouth contact coverage area 14, which is in general overlying registry with and extends at least slightly beyond the mouth contact area M of the can C. This mouth contact coverage area 14 of the seal 10 is surrounded and defined by a periphery 16, with the periphery 16 including some form of sealing means 18 (a narrow strip of adhesive, heat sealing, separate tape, etc.) disposed between the periphery 16 and the surface of the can C surrounding the mouth contact area M (excepting the seal extension portion 20 of the sheet 10, which provides for mechanical attachment of the sheet 10 to the pop tab assembly, as discussed below) . The sealing means 18 is preferably a food grade adhesive material, in order to avoid contamination of the can surface. It will be seen that it is preferable that the adhesive be relatively impervious to temperature extremes, in order to survive heating and cooling during product manufacture, shipping, and storage. Such adhesives are conventional and well known in the art. The sealing means 18 comprises a continuous narrow ring of sealing material surrounding the mouth contact area M of the can C, thereby precluding the entrance of dirt, dust, and/or other contamination between the seal 10 and the mouth contact area M of the can C.

The seal 10 is secured to the can C by more than adhesive means. While others have used such adhesives for attachment, this generally results in the complete removal of the seal, and the resulting additional piece of debris once the seal is removed. In contrast, the present seal 10 is also mechanically secured to the can C by a seal extension 20 (shown in FIG. 2) extending beyond the mouth contact coverage area 14 of the upper portion of the seal, and sandwiched between the top T and the pop tab pull ring R. The seal extension 20 is secured between the top T and pull ring R by the rivet A, which passes through a hole 22 in the seal extension 20 as shown in FIG. 2.

The mechanical attachment of the seal 10 to the can top T by means of the rivet A passing through the seal extension 20, permits the seal 10 to be swiveled or pivoted about the rivet A to provide access to the pop tab opening O, as discussed further below. However, it is possible that the rivet A attachment of the pop tab ring component R to the can top T may grip the seal extension 20 so tightly therebetween, that it may be difficult to rotate the seal 10 and its extension 20 between the can top T and the pop tab ring component R.

Accordingly, some form of bushing(s) washer(s), etc. may be installed about the rivet shank A, to each side of the seal extension 20 sheet. The bushing means provides some additional thickness in the area of the seal extension 20, in comparison to the relatively thin seal sheet 10. This provides additional clearance between the pop tab ring component R and the underlying top T of the can, so the portion of the seal 10 underlying the pop tab ring component R may be moved freely, i. e., rotated about the rivet A to expose the mouth contact area M of the can C when so desired.

FIG. 2 illustrates a first embodiment of this feature, wherein opposed first and second washers, respectively 28 and 30, are disposed to each side of the seal extension area 20. These washers 28 and 30 are preferably formed of the same material as the protective seal sheet 10, i. e., a biodegradable, food grade plastic material. However, other materials (stainless steel, aluminum, etc.) may be used as desired.

Figure 3:
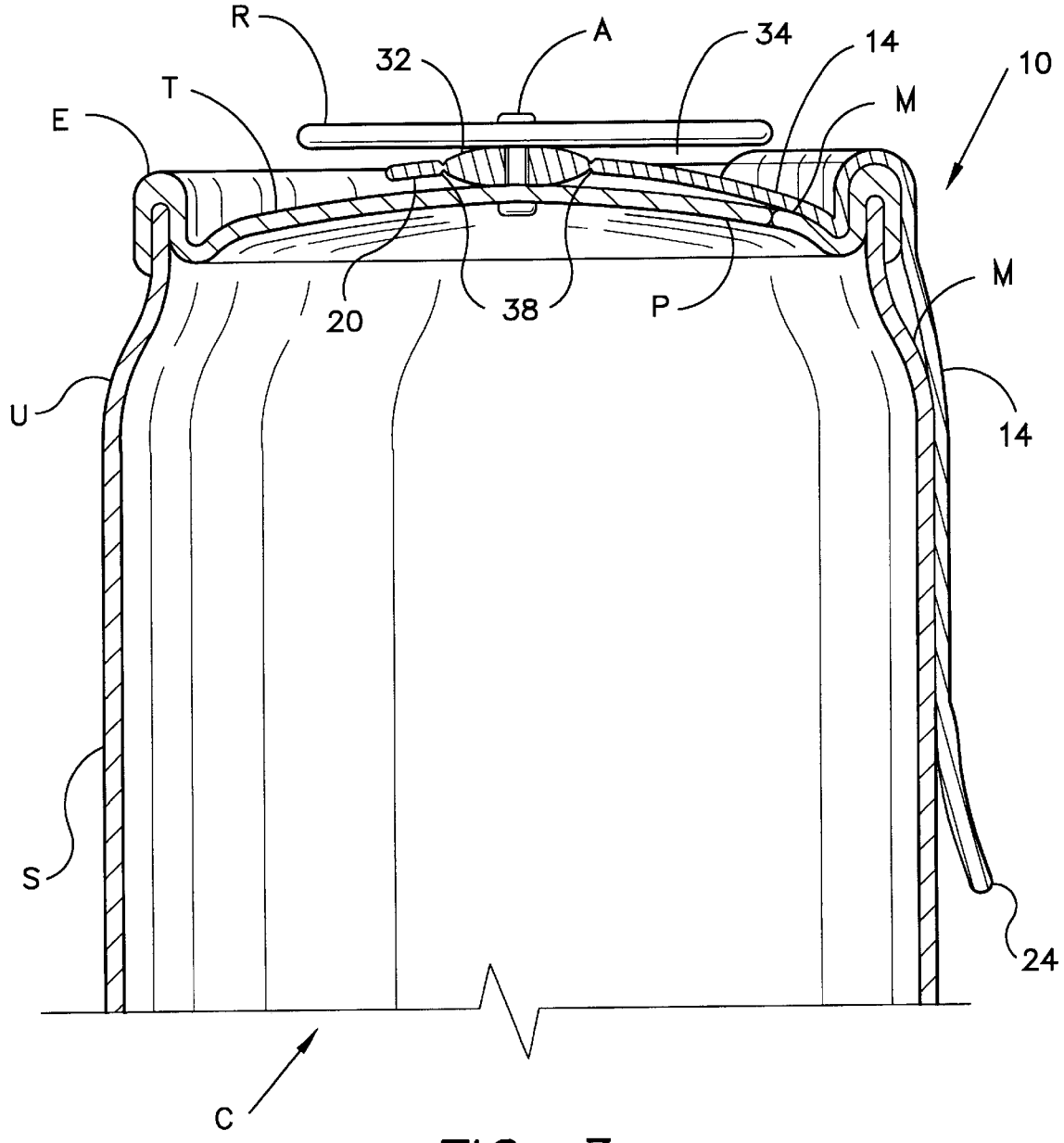
FIG. 3 is a side view in section of a can incorporating the present seal invention, illustrating another embodiment having a thickened area sandwiched between the tab lever and can top and a circumferential thinner area providing a line of weakening.

FIG. 3 provides an illustration of an alternative bushing construction. In FIG. 3, the central area of the seal extension 20 surrounding the rivet A, includes a thickened area or bushing 32 formed integrally therewith. This bushing area 32 serves the same purpose as the washers 28 and 30 shown in FIG. 2, in that it provides additional clearance in the seal capture area 34 between the pop tab R lever end and the underlying area of the can top T. Thus, the portion of the seal sheet 10 disposed between the pop tab ring R and the can top T, is not gripped tightly therebetween, and is able swivel or pivot about the rivet A and/or seal extension 20.

In some instances, the grip of the rivet A through the pop tab ring R and underlying can top T may be sufficiently strong as to preclude rotation of the seal sheet 10 about the rivet A, even when some form of bushing (washers 28 and 30, integral bushing 32, etc.) is provided with the seal extension 20 surrounding the rivet A. Accordingly, the seal extension area 20 may include a circumferentially disposed line of weakening surrounding the rivet hole 22. This line of weakening permits the primary portion of the seal sheet 10 to shear circumferentially about the seal extension portion 20, thus allowing the seal sheet 10 to rotate or pivot about the extension portion 20 which remains immovably gripped between the pop tab ring R and the can top T.

FIG. 2 illustrates a first embodiment of such weakening means, wherein the seal extension 20 includes a circumferential perforation line 36 disposed about the rive[009f] hole 22, immediately outboard of the bushing means, e. g., washers 28 and 30. An alternative line of weakening illustrated in FIG. 3, where the seal extension area 20 immediately outboard of the thickened bushing 32 is provided with a circumferential groove or score 38 on at least one side of the surface thereof, to produce a thinner line of material along the score or groove 38 to facilitate separation or shearing of the material therealong. Either means of weakening the seal extension 20 about its attachment with the rivet A, or other means providing the same function, is suitable for allowing the majority of the seal 10 to rotate about its attachment point if the seal extension 20 remains immovably captured.

The opposite lower end portion of the seal 10 includes a grip extension 24, which may include some form of high friction grip means 26 disposed thereon (embossed, etc.). It will be noted that the adhesive or sealing band 18 does not extend to the extreme end of the upper seal extension 20, which is secured to the pop tab assembly, nor to the extreme end of the grip extension 24; FIG. 2 illustrates this point particularly well. This allows the consumer to lift the grip extension 24 easily, without having to remove any adhesive or the like between the grip extension 24 and the underlying side S surface of the can C. Once the grip extension 24 has been lifted, the consumer may easily peel the lower mouth contact coverage portion 14 of the seal 10 from the mouth contact area M on the side of the can C, as shown in FIG. 4.

Figure 6:
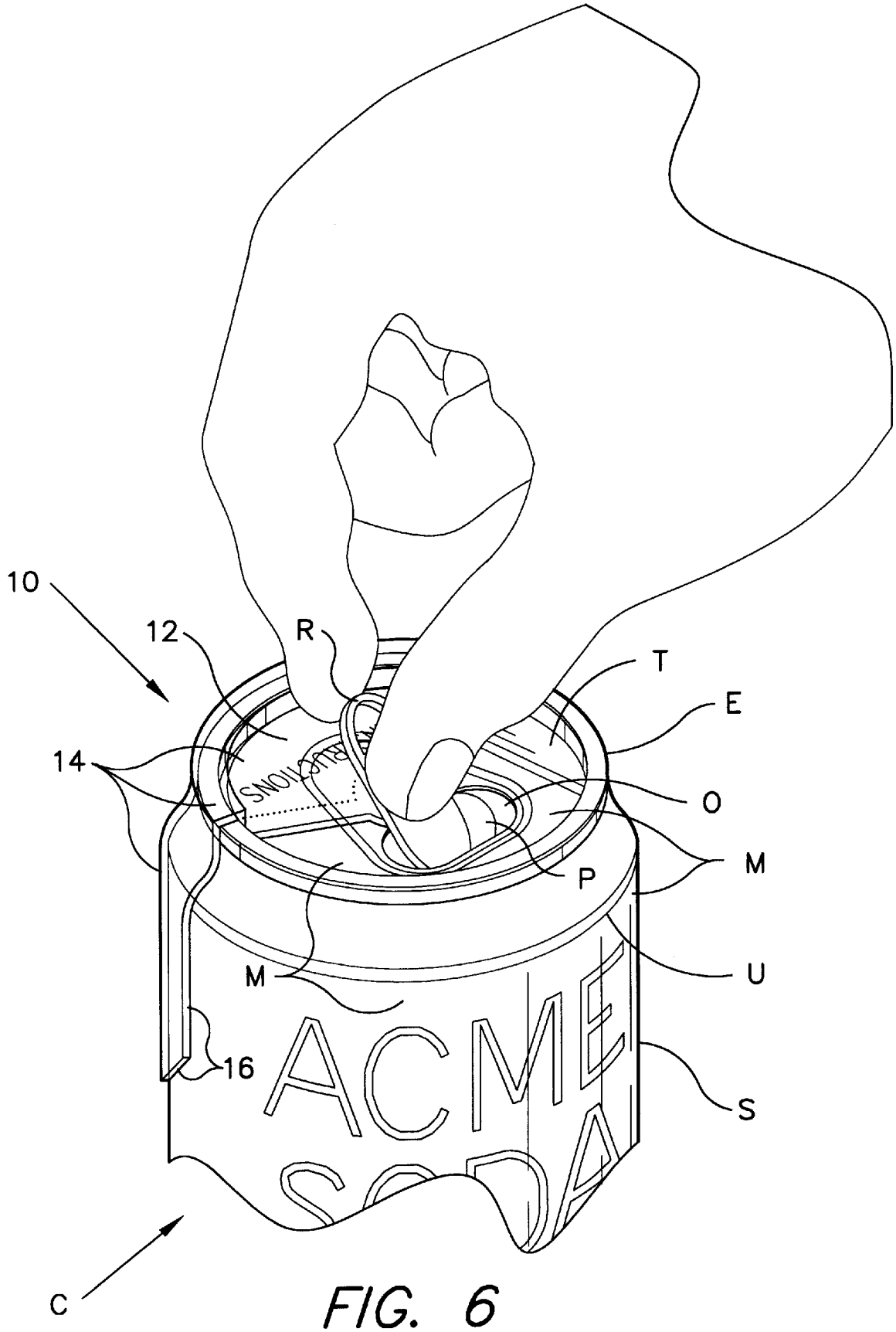
FIG. 6 is a perspective view of the upper portion of the can and seal assemblies of FIGS. 4 and 5, showing the final step in the process of opening the can.

Once the consumer has lifted the seal 10 from the top T of the can C, all of the sealing means 18 will be separated from the can C, generally as shown in FIG. 5 of the drawings. The only remaining area of the seal 10 which remains secured to the can is the seal extension 20, riveted between the top T and the tab pull ring R. As the generally peripheral sealing means 18 does not surround the rivet attachment, all of the sealing adhesive 18 is separated by lifting the grip extension 24 upwardly above the top T of the can C, as shown in FIG. 5. The seal 10 may then be swiveled around its attachment to the rivet A to position it to the opposite side of the can C from the tab P, as shown in FIGS. 5 and 6, allowing the consumer to open the tab P and pour or consume the contents of the can C freely without the seal 10 interfering.

The bushing means (washers 28 and 30 of FIG. 2, thickened integral bushing 32 of FIG. 3, etc.) facilitate the relatively free rotation of the seal sheet 10 about the rivet A. In the event that the seal extension area 20 is captured so tightly between the pop tab R and the can top T that it cannot pivot or swivel about the rivet A, the circumferential weakening line about the rivet A (perforations 36 of FIG. 2, scoring or grooves of FIG. 3, etc.) allow the majority of the seal 10 to shear circumferentially about the center of the seal extension 20. This allows the majority of the seal 10 to rotate or pivot about the rivet A and the relatively stationary seal extension portion 20 which is captured between the can top T and pop tab R by the rivet A. It will be seen that the various means facilitating the rotation or pivoting of the majority portion of the seal 10 about the rivet 20, may be employed either separately from one another, or in combination with one another, as required.

In summary, the present protective seal provides a much needed advance in consumer hygiene, by protecting the mouth contact area of a beverage can or the like from potential contamination from dirt, foreign matter, etc. between manufacture and sale to the consumer. The present seal is an advance over other devices developed in the past, particularly by means of the two independent methods of securing the seal to the can. The adhesive or other sealing means used generally about the periphery of the seal assures that no foreign matter will enter between the seal and the mouth contact area of the can, while the mechanical attachment by means of the conventional pop tab rivet assures that the seal will remain in place on the can, and may be discarded with the can when the can has been emptied. The rivet attachment allows the seal to be pivoted or swiveled completely clear of the mouth contact area of the can and the pop tab, thereby providing free access to the contents of the can.

The transparency, or at least translucence, of the present seal also provides advantages over seals of the prior art. The present seal is quite thin, which with its transparency, provides an unhindered view of the design disposed upon the can surface. The result is to provide a seal which is unobtrusive and easily opened, yet highly effective in providing a hygienic seal for the mouth contact areas of beverage cans and the like.

It is to be understood that the present invention is not limited to the embodiments described above, but encompasses any and all embodiments within the scope of the following claims.

I claim:

1. A protective seal for a beverage can having a sidewall and a top, a pop tab stamped into the top defining a sealed opening, a pop tab pull ring, and a rivet connecting the pop tab pull ring to the top, the protective seal comprising:

a thin, flexible, durable, impervious sheet of material, the sheet having a periphery and having a first portion for covering an area of the top over the pop tab and a second portion covering an area of the sidewall of the can so that the sheet covers an area of the top and the sidewall of the can contacted by a user's mouth;

a seal extension extending from the first portion of said sheet, the seal extension being disposed between the pull tab ring and the top of the can in order to retain the seal on the can;

means for sealing the periphery of said sheet to the can, provided that said seal extension is not sealed to the can; and bushing means disposed to each side of said seal extension and between the pop tab pull ring and the top of the can for providing clearance between the pop tab pull ring and the top of the can, the rivet extending through the bushing, said seal extension being movable between the pop tab pull ring and the top of the can, the seal being rotatable and pivoting horizontally about the rivet when said sealing means is broken in order to provide access to the opening in the top of the can.

2. The protective seal according to claim 1, wherein said bushing means comprises a thickened portion of said seal extension, formed integrally therewith.

3. The protective seal according to claim 1, wherein said bushing means comprises a pair of opposed washers disposed on opposite sides of said seal extension.

4. The protective seal according to claim 1, further including a circumferentially disposed line of weakening about said bushing means of said seal extension.

5. The protective seal according to claim 1, wherein said sheet is formed of a biodegradable material.

6. The protective seal according to claim 1, wherein said sheet is transparent.

7. The protective seal according to claim 1, wherein said sheet is at least partially tinted.

8. The protective seal according to claim 1, wherein said means for sealing said sheet over the mouth contact area of the can comprises a narrow food grade adhesive strip applied generally to said periphery of said sheet and excepting said seal extension of said sheet.

9. The protective seal according to claim 1, further including message means disposed upon said sheet.

10. The protective seal according to claim 1, further including grip means extending from the second portion of said sheet.

11. A container and seal therefor, comprising in combination:

a can including at least an upper sidewall and a top;

a pop tab assembly including:

a pop tab stamped into the top and defining a sealed opening in said top;

a pop tab pull ring; and a rivet securing said pop tab pull ring to the top adjacent said pop tab;

a thin, flexible, durable, impervious sheet of material, the sheet having a periphery and having a first portion for covering an area of the top over the pop tab and a second portion covering an area of the sidewall of the can so that the sheet covers an area of the top and the sidewall of the can contacted by a user's mouth;

a seal extension extending from the first portion of said sheet, the seal extension being disposed between the pull tab ring and the top of the can in order to retain the seal on the can;

means for sealing the periphery of said sheet to the can, provided that said seal extension is not sealed to the can; and bushing means disposed to each side of said seal extension and between the pop tab pull ring and the top of the can for providing clearance between the pop tab pull ring and the top of the can, the rivet extending through the bushing, said seal extension being movable between the pop tab pull ring and the top of the can, the seal being rotatable and pivoting horizontally about the rivet when said sealing means is broken in order to provide access to the opening in the top of the can.

12. The protective seal according to claim 11, wherein said bushing means comprises a thickened portion of said seal extension, formed integrally therewith.

13. The protective seal according to claim 11, wherein said bushing means comprises a pair of opposed washers disposed to each side of said seal extension.

14. The protective seal according to claim 11, further including a circumferentially disposed line of weakening about said bushing means of said seal extension.

15. The container and seal combination according to claim 11, wherein said sheet is formed of a biodegradable material.

16. The protective seal according to claim 11, wherein said sheet is transparent.

17. The container and seal combination according to claim 11, wherein said sheet is at least partially tinted.

18. The container and seal combination according to claim 11, wherein said means for sealing said sheet over the mouth contact area of the can comprises a narrow food grade adhesive strip applied generally to said periphery of said sheet and excepting said seal extension of said sheet.

19. The container and seal combination according to claim 11, further including message means disposed upon said sheet.

20. The container and seal combination according to claim 11, further including grip means extending from the second portion of said sheet.

* * * * *